United States Patent [19]

Debenham et al.

[11] 4,155,480

[45] May 22, 1979

[54] PUSH-IN EASY OPENING CLOSURES

[75] Inventors: Michael Debenham, Frankston; Allan G. Dalli, Warrandyte; Peter L. Revill, Middle Park, all of Australia

[73] Assignee: The Broken Hill Proprietary Company, Limited, Melbourne, Australia

[21] Appl. No.: 889,839

[22] Filed: Mar. 24, 1978

Related U.S. Application Data

[63] Continuation-in-part of Ser. No. 839,213, Oct. 4, 1977, Pat. No. 4,105,134.

[30] Foreign Application Priority Data

Jun. 10, 1977 [AU] Australia ..... 0416/77
Jul. 14, 1977 [AU] Australia ..... 0848/77
Sep. 28, 1977 [AU] Australia ..... 1840/77

[51] Int. Cl.[2] ..... B65D 41/32
[52] U.S. Cl. ..... 220/268
[58] Field of Search ..... 220/265–273

[56] References Cited

U.S. PATENT DOCUMENTS

| | | | |
|---|---|---|---|
| 3,760,752 | 9/1973 | Geiger | 113/112 C |
| 3,888,199 | 6/1975 | Herrmann | 113/121 C X |
| 3,889,842 | 6/1975 | Bennett | 220/253 |
| 3,912,113 | 10/1975 | Peyser et al. | 220/268 |
| 3,952,912 | 4/1976 | Perry | 220/269 |
| 3,958,717 | 5/1976 | Ellis | 220/268 |
| 3,980,200 | 9/1976 | Klein | 220/268 |

*Primary Examiner*—George T. Hall
*Attorney, Agent, or Firm*—Murray and Whisenhunt

[57] ABSTRACT

This specification discloses improvements in push-in easy opening closures of the pressure releasing type which are designed to substantially reseal once a digitally applied push-in force causing them to open is released. In one form of the invention, the pressure releasing closure is formed partly within the confines of a pouring closure and partly outside the pouring closure whereby the pressure releasing closure is permanently opened when the pouring closure is opened. In another embodiment, the pressure releasing closure is connected to the can end adjacent its countersink whereby the opened closure defines a liquid draining hole when opened. The specification also discloses a can end having a closure formed so that the sheet metal at its hinge is relatively undisturbed. A method of forming such a closure is also disclosed.

9 Claims, 11 Drawing Figures

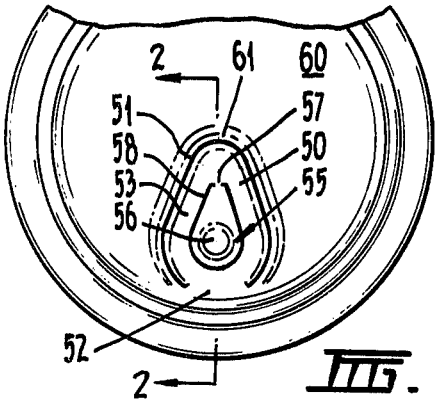
FIG. 1.
FIG. 2.
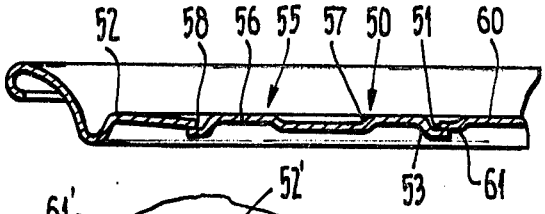
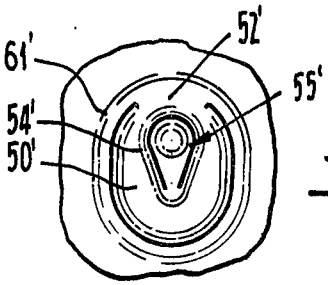
FIG. 3.
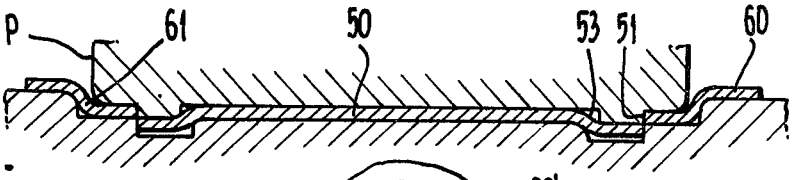
FIG. 4.
FIG. 5.
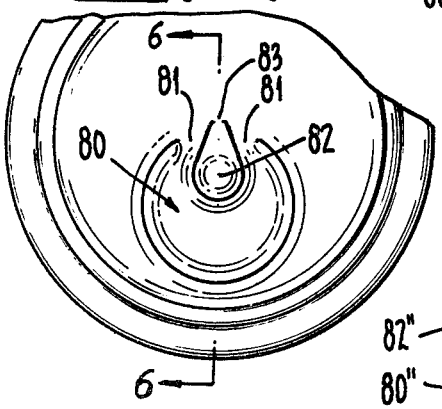
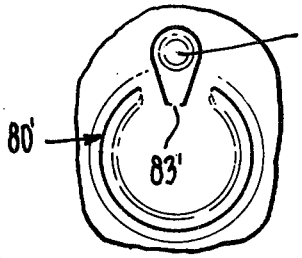
FIG. 8.
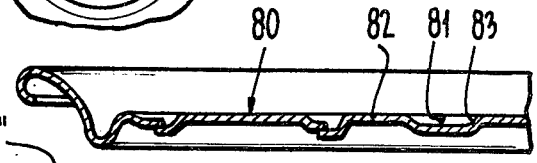
FIG. 6.
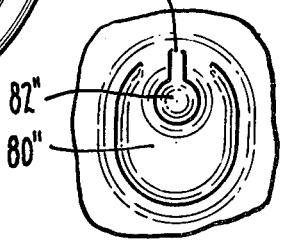
FIG. 10.
FIG. 9.
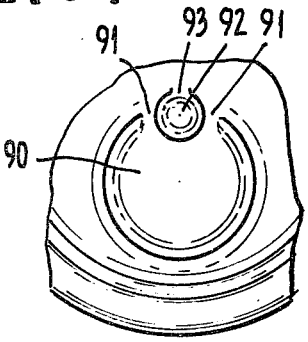
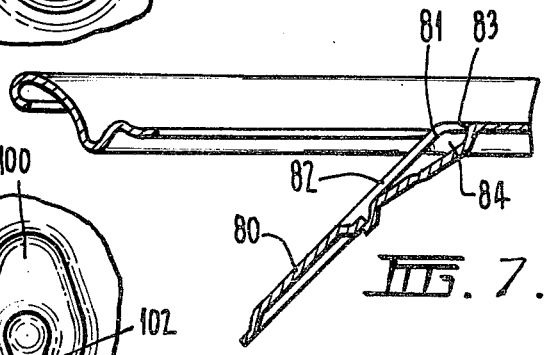
FIG. 7.
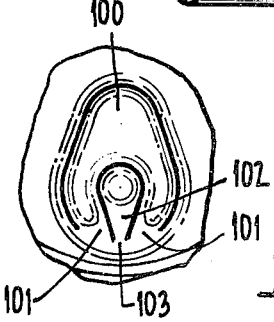
FIG. 11.

PUSH-IN EASY OPENING CLOSURES

RELATED APPLICATIONS

This application is a continuation-in-part of application Ser. No. 839,213 Debenham et al., filed Oct. 4, 1977, now U.S. Pat. No. 4,105,134.

BACKGROUND OF THE INVENTION

This invention relates to improvements in push-in easy opening closures, particularly, but not exclusively, pressure releasing vent closures, and to container members incorporating such closures.

In our application Ser. No. 839,213, we disclose several different closure arrangements as applied to can ends for containers for highly carbonated beverages. The problems of the prior art and the solutions provided by the invention described and claimed in this application are discussed in detail in the specification of our earlier application and the disclosure of this specification is hereby incorporated into the present application by cross-reference.

It is an object of this invention to provide several alternative closure arrangements.

It is also an object of the invention to provide an improved closure protective arrangement in a container member such as a can end together with a method of forming such protective arrangement and the closure.

SUMMARY OF THE INVENTION

The present invention provides a container member for use in a container for pressurized liquid, said container member including a push-in easy opening closure defined by at least a weakening line, a smaller pressure releasing closure defined by at least a weakening line and capable of being opened by a push-in force, said pressure releasing closure being formed partly within said pouring closure and partly outside said pouring closure, said pressure releasing closure being arranged so as to be permanently opened when said pouring closure is opened to create an air venting passageway to assist in the venting of the contents of the container during pouring or drinking therefrom.

The present invention also provides a container member for use in a container for pressurized liquids, said container member having a push-in easy opening closure formed in an area of said container member, the improvement comprising said closure being formed within a downwardly depressed area within the sheet metal defining the container member, said closure having a peripheral portion which extends downwardly and outwardly from the remainder of the closure into overlapping and underlying relationship with the sheet metal surrounding the opening closed by said closure.

The present invention further provides a container member for use in a container for pressurized liquids, said container member having a push-in easy opening closure formed in an area of said container member in overlapping underlying relationship with the sheet metal surrounding the opening closed by said closure, said closure having a peripheral portion which extends downwardly and outwardly from the remainder of the closure and being integrally connected to said container member by a hinge portion, said sheet metal surrounding said opening being worked, the improvement comprising said sheet metal defining said hinge portion being relatively undisturbed and being disposed at about the same level as the remainder of said closure.

The invention also provides a method of forming a closure in a sheet metal container member, including piercing said closure from said container member and during the piercing operation downwardly reforming the periphery of said closure whereby the main part of the closure remains at substantially the same level during the formation of the closure, and creating overlap between said closure and and the sheet metal surrounding the opening created by said piercing operation.

The present invention still further provides a method of forming a closure in a sheet metal container member, comprising piercing said closure from said container member and during said piercing operation downwardly reforming the sheet metal surrounding the opening to be closed by said closure whereby said closure is located within a downwardly depressed area within said container member, and reducing the size of the opening and/or increasing the size of said closure to produce overlap between the closure and the opening surround.

DETAILED DESCRIPTION OF THE INVENTION

In order that the invention may be more readily understood, several preferred embodiments of the invention will now be described with reference to the accompanying drawings in which:

FIG. 1 is a plan view of one embodiment of the invention;

FIG. 2 is an enlarged sectional elevation along the line 1—1 in FIG. 1;

FIG. 3 is a plan view of a modification of the embodiment of FIG. 1;

FIG. 4 is a schematic representation of one of the stages in the formation of the closure of FIGS. 1 and 2;

FIG. 5 is a plan view of a second embodiment of the invention;

FIG. 6 is an enlarged sectional elevation along the line 6—6 in FIG. 5;

FIG. 7 is a view similar to FIG. 6 showing the closures in the open position; and FIGS. 8, 9, 10 and 11 are plan views of modifications of the embodiment of FIG. 5.

Referring firstly to FIGS. 1 and 2 of the drawings, the can end shown has a fully sheared closure member or tab 50 which overlaps with and underlies the metal surrounding a generally pear shaped opening 51 and is hinged to the end at 52. The tab 50 has a central area 53 which is raised with respect to the periphery of the tab. However, it will be noted that the raised area 53 is at the same general level as the sheet metal defining the hinge 52 whereby the hinge metal is substantially undeformed by the closure forming process which will be defined in more detail below. Tests carried out to date appear to suggest that the undisturbed nature of the metal at the hinge 52 may well increase the pressure at which peaking or buckling of the end will occur in this general area of the end.

The tab 50 has a pressure releasing closure member or tab 55 formed therein in the manner shown in FIGS. 1 and 2 of the drawings. The tab 55 is formed with an upwardly raised button 56 at the end of a relatively elongate narrow area of metal defining the tab. The tab is hinged to the sheet metal defining the tab 50 at 57 and overlaps with and underlies the sheet metal surrounding the sheared opening 58. Both closures are hermetically sealed by means of a sealant (not shown) and the pressure releasing closure operates in the same manner as the pressure releasing closures described in the earlier application referred to above. However, it will be appreciated that in most opening operations the two closures will be opened by means of a single unidirectional push-in force applied in the general area of the raised button 56 on the pressure releasing tab 55. Of course, in the situations described in the earlier application it may be necessary to actuate the pressure releasing closure several times. However, it should not be necessary for the user to relocate his or her digit for the final opening operation in which the tab 50 is fully opened. If desired the tab 55 may be located in an inverted position adjacent the narrow end of tab 50 to ensure that relocation of the digit is not required during the opening of tab 50.

A further modification of the embodiment of FIG. 1 is shown in FIG. 3. In this closure tab arrangement, the pouring tab 50' has an oblate configuration and is located in an inverted position with its hinge 52' located near the centre of the can end. The pressure releasing tab 55' is located within a depressed region 54' in the tab 50' to protect the tab 56' but is otherwise substantially identical to the tab 55.

The arrangement of the tabs 50' and 55' in this manner has the advantage of locating the tab 55' nearer to the centre of the can end where the headspace is likely to be greater. The can end is formed with an identation 62 surrounding the closure 50'. This serves as a sealant well when sealant is applied to the closure 50' and also allows the sheet metal to be clamped to inhibit metal migration when the sheet metal around the opening 51' is coined to create overlap.

The above embodiments of the invention are similar in construction to the closure described in U.S. Pat. No. 3,741,432 Werth et al. with the exception that the pressure releasing tab 55 is formed as described in our earlier application rather than in the manner shown in the U.S. patent. Thus, the closure shown in FIGS 1 and 2 will have the same advantages over the Werth et al. closure as the other embodiments of our earlier application have over the prior art shown in FIG. 1 of our earlier application. Furthermore, the use of a common hinge area, as shown in FIGS. 1 and 3 of the Werth et al. patent, may have disadvantages in that the depression of the pouring tab 15 causes further depression of tab 21 thereby increasing the likelihood of the hinge fracturing to detach the tab 21 from the can end.

It will be noted from FIGS. 1 and 2 of the drawings that the closures 50 and 55 are formed in a downwardly depressed area 61 which extends into the end from the hinge area 52 in the same general configuration as the tab 50. The location of the closures 50 and 55 within the depressed area 61 protects the closure 50 against unintentional actuation and to a lesser extent the closure 55 is similarly protected against unintentional actuation. It will be noted from the sectional elevation of FIG. 2 that the top of the button 56 is located at the same general level as the surrounding sheet metal of the central panel.

The closures 50 and 52, and 50' and 52', may be formed in a can end blank by any suitable method of piercing and reforming the sheet metal of the end blank. Under normal circumstances the method used would involve several separate die operations, and the punch/-die sets used would require the usual stripper plates and die ejectors for ensuring separation between sheet metal and the punch and die components. The use of stripper plates and die ejectors complicate the punch/die sets and the desirability of reducing the number of die operations is obvious.

In our earlier application, we described a closure forming method in which the piercing or shearing of the tabs 50 and 55 was combined with the downward reforming of the periphery of the tabs 50 and 56 to significantly improve the prior art methods. We have now discovered that the piercing of the tabs 50 and 55 can also be combined with the reforming of the sheet metal surrounding the openings to form the downwardly depressed area 61 surrounding the closure 50 and the formation of the button 56. This single die operation is shown schematically in FIG. 4 which is a fragmentary sectional view across the punch/die set in the region of tab 50 but excluding tab 55. It will be noted that the punch P is formed with a shoulder and a central recess, while the die D is formed with cooperating shoulders and recesses to facilitate the downward reforming of the tab 50 and the surround 61.

It has been found that the single operation piercing and reforming not only reduces the number of die stages but also removes the need for stripper plates and die ejectors. The resulting tab and opening are found to be substantially the same size after the piercing/reforming operation and accordingly they do not stick in the die or on the punch.

The above method still has the advantage of maintaining the central portion of the tab 50 at the same general level as the unpierced metal defining the hinge.

In the second operation, the sheet metal around the periphery of the tabs 50 and 55 and the sheet metal around opening 51 are coined to create the necessary overlap between the tabs 50 and 55 and the sheet metal surrounding them. Alternatively, the overlap can be achieved by the methods described in our earlier application. Following this, sealant is applied in the regions of the cut edges of the tabs 50 and 55 to hermetically seal the two closures.

The above method of forming the improved closure is preferred for several reasons. Firstly the piercing and reforming operations are performed in one die stage thereby reducing the number of stages and excluding the stripper plates and die ejectors. Secondly, formation of the closure within the downwardly depressed area 61 in the central panel provides protection against unintentional opening of the closure. Thirdly, the downward reforming of the periphery of the tab 50 enables its central portion to remain at the same level as the hinge 52 and it is believed that this may well improve the pressure performance of the converted end. This method of forming the tab 50 also enables the pressure releasing tab 55 to be sheared from the tab 50 in the same die operation without any undesirable deformation of the tab 50. To form the same type of closure combination in a flat or upwardly raised area of metal, the shearing of the tabs may result in downward turning of the edges of the larger tab which may need to be flattened or restored in a subsequent die operation.

It will be appreciated that in forming the closure arrangement shown in FIG. 3 the downward reforming of the sheet metal surrounding the tab 55' will be performed in the first die operation. This method may also be used to form the modifications to be described below.

Referring now to FIGS. 5 to 7, a modified form of pressure release closure is shown. Once again, the closures are formed within a depressed region of the can end and the general method of formation of the end is substantially as described above.

The embodiment of FIGS. 5 to 7 includes a fully sheared closure member or tab 80 which overlaps with and underlies the metal surrounding a generally circular pouring/venting opening and is hinged to the end at 81. A pressure releasing closure or tab 82, of the same type as tab 55 in FIGS. 1 and 2, is formed partly within the tab 80 and is connected to the end at 83, which connection is located outside the tab 80 and about which the tab 82 flexes in the manner described in the earlier application. As shown in FIG. 6, the tab 82 overlaps and underlies the surrounding sheet metal of tab 80. In this embodiment, ovelap of the tabs 80 and 82 is increased by coining the periphery of the tabs and the sheet metal adjacent the opening closed by tab 80. The dimensions of tab 82 are selected in accordance with the earlier application to prevent permanent opening thereof by a digitally applied force.

In use, the tab 82 is opened to relieve the pressure within the can. In most cases, the force digitally applied to the tab 82 will also open the tab 80, once the pressure is relieved. However, because the tab 82 is located near the hinge line of tab 80, this tab will tend to open controllably rather than suddenly to avoid accidental injury to the digit from the sides of the opening.

When the closure 80 is opened as shown in FIG. 7, the closure 82 is forced to open about its connection 83 and because of the separation between the hinge 81 and the connection 83, the neck of metal joining the tab 82 and the connection 83 will be displaced below the surrounding metal of tab 80 and the can end to create a passageway 84 which acts as an air vent during the pouring or drinking operations. This improves the pouring and drinking characteristics of the end, especially the drinking characteristics in the event that the user's mouth substantially covers the pouring opening.

A modification of the embodiment of FIGS. 5 to 7 is shown in FIG. 8. In this embodiment the pouring and pressure releasing tabs 80′ and 82′ are identical in construction to the tabs 80 and 82 but the position of tab 82 is inverted so that the main operating portion thereof lies outside the pouring tab 80′ and the tab 82′ is connected to the tab 80′ at 83′.

The main advantages of this embodiment over the preceding embodiment are that the pouring tab 80′ cannot be accidently opened when the pressure releasing tab 82′ is opened and a larger air venting passageway is formed when the large tab is opened because the main operating portion of the tab 82′ is removed from its opening when tab 80′ is opened to the position shown in FIG. 7.

The same pouring/drinking characteristics may be achieved without the use of a resealable pressure release tab of the type shown in FIG. 4. However, the use of this type of tab is preferred for the reasons expressed in our earlier application.

Referring now to FIG. 9, the can end is formed with a fully sheared closure member or tab 90 which overlaps with and underlies the metal surrounding the opening in the same manner as tab 80. The tab 90 is hinged to the end about 91 and a small non-resealable pressure releasing closure tab 92 is formed over the hinge line with part of the tab 92 projecting into the tab 90. The tab 92 is formed in basically the same manner as tab 82 only it is hinged to end about 93 in such a manner that the metal defining the connection permanently deforms when the tab 92 is opened to release the pressure within the can. When the pouring tab 90 is opened, the tab 92 is still further opened as in the preceding embodiment to create a permanent venting passage for the pouring/drinking operations.

The embodiment of FIG. 9 may also be modified similarly to the embodiment of FIG. 7 by inverting the tab 92.

It will be appreciated that in each of the preceding embodiments, the shape of each of the tabs may be varied at the designer's choice. For example, as shown in FIG. 10, the embodiment of FIG. 5 is modified so that the tab 80″ is oblate and the tab 82″ is formed with a circular operating portion having a straight sided neck extending therefrom to the connection 83″. Similarly the tab 80 or the tab 82″ may be pear-shaped as in FIG. 1. The tabs 90 and 92 in FIG. 8 may be similarly modified.

A still further modification is shown in FIG. 11. In this embodiment, the tab 100 is pear-shaped and its hinge 101 is located adjacent the countersink of the can end. The pressure releasing tab 102 is similar to the tab 82 and has its connection 103 to the end located outside the tab 100 and spaced from the hinge 101. The two tabs have the same basic construction as the preceding embodiments.

The above embodiment opens similarly to the closure shown in FIGS. 5 to 7 but the tab 102 does not act as a vent during pouring and drinking. Instead the opening created by the tab 102 when the tab 100 opened facilitates additional draining of the contents of the can thereby overcoming one of the problems inherent in positioning the hinge 101 near the countersink.

It may be desirable, where the hinges of tabs 80, 90 and 80″ and tabs 82, 92 and 82″ are located near the centre of the can end, to restrict the extent to which the tabs can be bent about their hinges. This can be achieved by forming an indent or otherwise suitably shaping the undersides of tabs 80, 90 and 80″ so that the forward edges of the tabs 82, 92 and 82″ are engaged within the indent or shaping whereby the tabs 82, 92 and 82″ act as a strut to prevent further bending movement of the tabs 80, 90 and 80″ respectively. In some cases this function may be achieved sufficiently by the frictional contact between the two tabs or by the sealant applied to the tabs. Such an arrangement reduces the likelihood that the hinge metals connecting the tabs to their ends will fracture. This is not a problem with the FIG. 11 embodiment since the can wall prevents bending beyond about 90°.

The embodiments of FIGS. 5, 8 and 9 have some similarity with the can end described in Werth et al. U.S. Pat. No. 3,741,432 432 in that the pressure releasing tabs are located partly within the pouring tabs. However, in the present invention the pressure releasing tab is partly located outside the pouring tab and its hinge or connection is not coincident with the hinging connection of the pouring tab to the end. This provides the quite distinct advantage that a separate air venting passageway, outside the confines of the opening closed by the pouring tab, is formed when the pouring tab is opened, whether or not the pressure releasing tab has been opened previously. While the Werth et al. patent describes the release vent tab 21 as remaining open when the tab 15 is opened to create an air admission opening, this opening is unlikely to contribute significantly to the venting of the contents during normal pouring or drinking from the can since sufficient air will be admitted through the can opening. However, if the can is tilted so that the main opening is immersed in liquid, the opening created by the tab 21 will also be immersed thereby preventing the admission of air to the can.

In the embodiments described above, the separate air venting passageway will remain open even when the pouring opening is full of liquid since the venting tab extends outside the pouring opening. Furthermore, the air vent passageways created in the present embodiments are less likely to be covered during the drinking operation, even if the whole of the pouring opening is covered by the mouth of the user.

We claim:

1. A container member for use in a container for pressurized liquid, said container member including a push-in easy opening closure defined by at least a weakening line, and a smaller pressure releasing closure defined by at least a weakening line and capable of being opened by a push-in-force, said pressure releasing closure being formed partly within said pouring closure and partly outside said pouring closure, said pressure releasing closure being arranged so as to be permanently opened when said pouring closure is opened to create an air venting passageway to assist in the venting of the contents of the container during pouring or drinking therefrom.

2. The container member of claim 1, wherein said pressure releasing closure is integrally connected to said container member or to said pouring closure, said closure flexing about said connection during the opening operation, said pressure releasing closure being constructed to return substantially to its closed position in the absence of said push-in force.

3. The container member of claim 2, wherein said pressure releasing closure is constructed to prevent deflection of said closure by a digitally applied push-in force beyond the angle at which the elastic limit of the metal at said connection is exceeded.

4. The container member of claim 3, wherein said pressure releasing closure is remote from its connection to said container member to prevent deflection of said connection beyond said angle.

5. The container member of claim 1, wherein said pressure releasing closure is integrally connected to said container member and about which connection said closure hinges during the opening operation, said pressure releasing closure being constructed to permanently deform said connection on opening thereof.

6. The container member of claim 1, wherein said container member is formed from sheet metal, said closure and said pressure releasing closure being fully sheared from said sheet metal except for a portion connecting said closures to said container member, said closures and said pressure releasing closure overlapping and underlying the sheet metal surrounding the opening closed by said closures.

7. A container end for use in a container for pressurized liquid, said container end including a push-in easy opening closure defined by at least a weakening line, and a smaller pressure releasing closure defined by at least a weakening line and capable of being opened by a push-in force, said pressure releasing closure being formed partly within said pouring closure and partly outside said pouring closure, said pressure releasing closure being arranged so as to be permanently opened when said pouring closure is opened, said closures being integrally connected to said container end at a position adjacent the periphery of the end whereby said permanently opened pressure releasing closure creates a liquid draining opening which facilitates substantially complete draining of the contents of a liquid filled container having said container end.

8. A container member for use in a container for pressurized liquids, said container member having a push-in easy opening closure formed in an area of said container member, the improvement comprising said closure being formed within a downwardly depressed area within the sheet metal defining the container member, said closure having a peripheral portion which extends downwardly and outwardly from the remainder of the closure into overlapping and underlying relationship with the sheet metal surrounding the opening closed by said closure, wherein said closure is integrally attached to said container member by a hinge portion, said remainder of said closure being disposed at about the same level as said hinge portion whereby the sheet metal defining said hinge portion is relatively undisturbed.

9. A container member for use in a container for pressurized liquids, said container member having a push-in easy opening closure formed in an area of said container member in overlapping underlying relationship with the sheet metal surrounding the opening closed by said closure, said closure having a peripheral portion which extends downwardly and outwardly from the remainder of the closure and being integrally connected to said container member by a hinge portion, said sheet metal surrounding said opening being worked, said container member also having a smaller pressure releasing closure capable of being opened by a push-in force and being integrally connected to said container member by a hinge portion, the improvement comprising said sheet metal defining said hinge portion being relatively undisturbed and being disposed at about the same level as the remainder of said closure, and the hinge portion of said easy opening closure and the hinge portion of said pressure releasing closure being spaced apart from each other.

* * * * *